US005623456A

United States Patent [19]

Miyamoto et al.

[11] Patent Number: 5,623,456

[45] Date of Patent: Apr. 22, 1997

[54] ELECTROLUMINESCENT INDICATOR HAND

[75] Inventors: Shinichi Miyamoto; Nobuhiro Tanaka, both of Tokyo, Japan

[73] Assignee: Seiko Clock Inc., Japan

[21] Appl. No.: 549,092

[22] Filed: Oct. 27, 1995

[30] Foreign Application Priority Data

Oct. 27, 1994 [JP] Japan ..... 6-264030

[51] Int. Cl.[6] ..... G04B 19/32; G04B 19/04

[52] U.S. Cl. ..... 368/226; 368/238

[58] Field of Search ..... 368/67, 76, 80, 368/223, 226, 228, 238; 116/286–288, 328; 427/66

[56] References Cited

U.S. PATENT DOCUMENTS

| | | | |
|---|---|---|---|
| 2,655,783 | 10/1953 | Uschkamp | 368/226 |
| 3,079,748 | 3/1963 | Hultquist | 368/226 |
| 4,993,005 | 2/1991 | Watanabe | 368/226 |
| 4,995,022 | 2/1991 | Ikeda et al. | 368/226 |
| 5,265,071 | 11/1993 | Thorgersen et al. | 368/67 |
| 5,320,063 | 6/1994 | Ogura et al. | 116/288 |
| 5,346,718 | 9/1994 | Thorgersen et al. | 427/66 |

FOREIGN PATENT DOCUMENTS

| | | |
|---|---|---|
| 56-97715 | 12/1981 | Japan . |
| 6-34035 | 3/1994 | Japan . |
| 937669 | 9/1963 | United Kingdom . |

*Primary Examiner*—Vit W. Miska
*Attorney, Agent, or Firm*—Adams & Wilks

[57] ABSTRACT

An improved electroluminescent indicator hand which is capable of emitting light from its entire surface area consists of an annular support member mounted on the hand shaft of a timepiece, an electroluminescent indicator hand secured on the support member, and a metal contact for supplying a drive signal to the electroluminescent indicator hand. The electroluminescent indicator hand is formed by sequentially laminating a transparent electrode layer, a luminescent layer, an insulating layer and a rear electrode layer on the rear surface of a light transmissive substrate, which has sufficient rigidity, and has at one end an annular section overlapping the support member. The metal contact has plural conductors resiliently contacting the transparent electrode layer and the rear electrode layer of the electroluminescent hand, and is welded to the support member so as to secure the electroluminescent member therebetween. Since a hand frame is not necessary, the cost of individual components and the assembly thereof is substantially reduced. In addition, it is possible to make the hand thinner than a conventional indicator hand. A desirable three-dimensional visual effect can be also achieved.

8 Claims, 4 Drawing Sheets

ELECTROLUMINESCENT INDICATOR HAND

The present invention relates to an electroluminescent indicator hand of the type used in an analog display of an instrument such as a timepiece.

BACKGROUND INFORMATION

A conventional electroluminescent indicator hand of a timepiece is illustrated in FIG. 4. In the conventional electroluminescent indicator hand, an electroluminescent ("EL") member b from the lower end of which a metal lead a projects is integrally laminated with a moisture resistant film, and the electroluminescent member b is mounted in a hollow section of a resin indicator hand frame c. The electroluminescent member b comprises a laminated structure having a luminescent layer, an insulating layer, and a rear electrode film. The transparent electrode film is formed by vacuum evaporating a transparent electrode layer comprising, for example, indium-tin-oxide (ITO) on a polyethylene terephthalate (PET) film. The laminated structure is then sealed with a moisture resistant film. A metal conductor d is welded on the shaft of the resin indicator hand frame c, and soldered to the lead a of the electroluminescent member b. Examples of this conventional structure are illustrated in Japanese Utility Model Application Laid-Open No. 56-97715 and Japanese Patent Application Laid-Open No. 6 34035.

However, since the conventional electroluminescent indicator hand is formed by attaching the electroluminescent member b and the conductor d on the resin indicator hand frame c, there is a drawback in that the conventional arrangement is overly complicated, resulting in an increase in the cost of the individual components as well as in the assembly thereof. In addition, since the electroluminescent member b is mounted on the rear surface of the resin indicator hand frame c, there is another drawback in that light emission from the electroluminescent hand is limited to the area forming the window opening in the hand frame c. Since light emission is limited to only a portion of the indicator hand, only a limited amount of light may be produced by the conventional electroluminescent indicator hand.

SUMMARY OF THE INVENTION

In view of the foregoing, it is an object of the present invention to provide an electroluminescent indicator hand which does not require a hand frame, by forming an electroluminescent member directly on a light transmissive substrate which serves as the body of the indicator hand, and which can therefore emit light over the entire surface area of the indicator hand.

In order to achieve the above objects and others which will become apparent to those of ordinary skill in the art, an improved electroluminescent indicator hand is provided which comprises an annular support member mounted on a shaft, an elongated electroluminescent member secured to the support member, and a metal lead for supplying a drive signal to the electroluminescent member. The electroluminescent member comprises a laminated structure formed by sequentially laminating a transparent electrode layer, a luminescent layer, an insulating layer and a rear electrode layer on a surface of a light transmissive substrate having sufficient rigidity, and which has an annular section overlapping the support member. The metal lead has conductors resiliently contacting the transparent electrode layer and the rear electrode layer of the electroluminescent member, and the metal lead is welded to the support member while holding the annular section therebetween such that the electroluminescent member is secured on the support member.

BRIEF DESCRIPTION OF THE DRAWINGS

FIG. 1(*b*) is a rear view of the electroluminescent indicator hand of FIG. 1(*a*);

FIG. 4(*b*) is a rear view of the conventional electroluminescent indicator hand.

DETAILED DESCRIPTION OF THE PREFERRED EMBODIMENTS

Preferred embodiments of the present invention will now be described in detail with reference to the attached drawings.

Figures 1A, 1B:
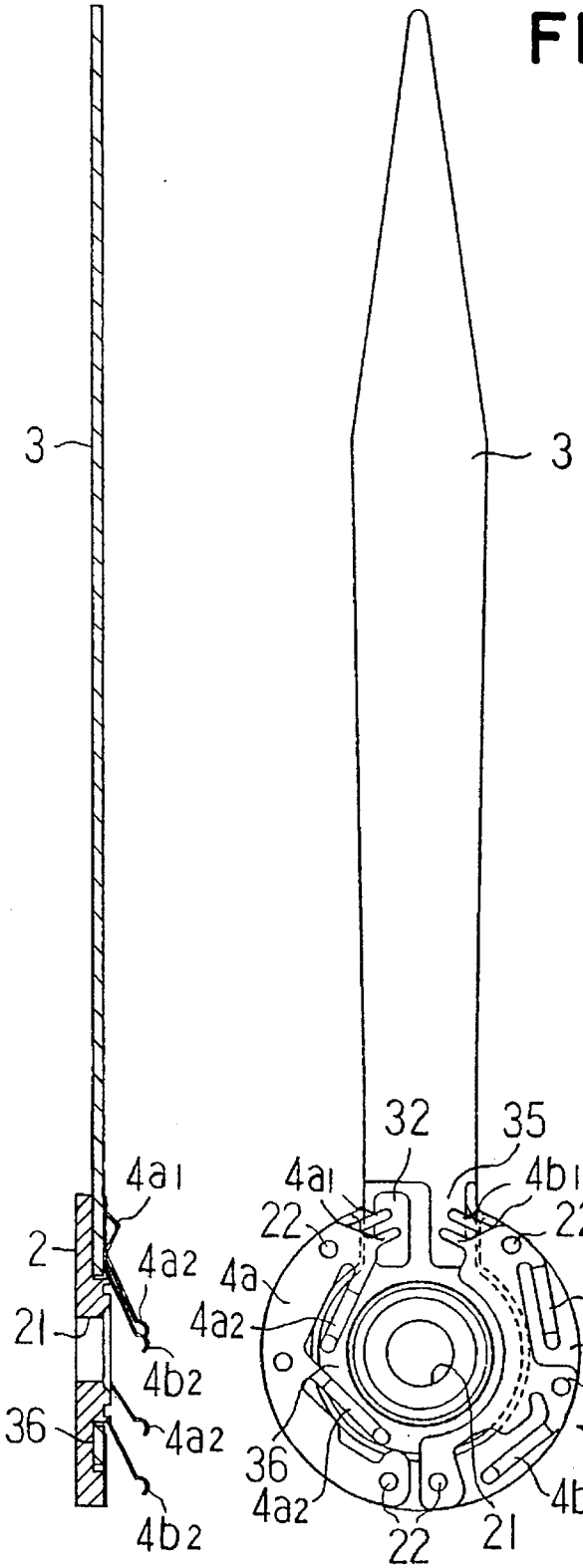
FIG. 1(*a*) is a longitudinal sectional view illustrating an electroluminescent indicator hand in accordance with a first embodiment of the present invention.

As illustrated in FIGS. 1(*a*) and 1(*b*), an electroluminescent indicator hand according to a first embodiment of the present invention comprises a support member 2, an electroluminescent member 3, and metal contacts 4*a*, 4*b*.

Figure 3:
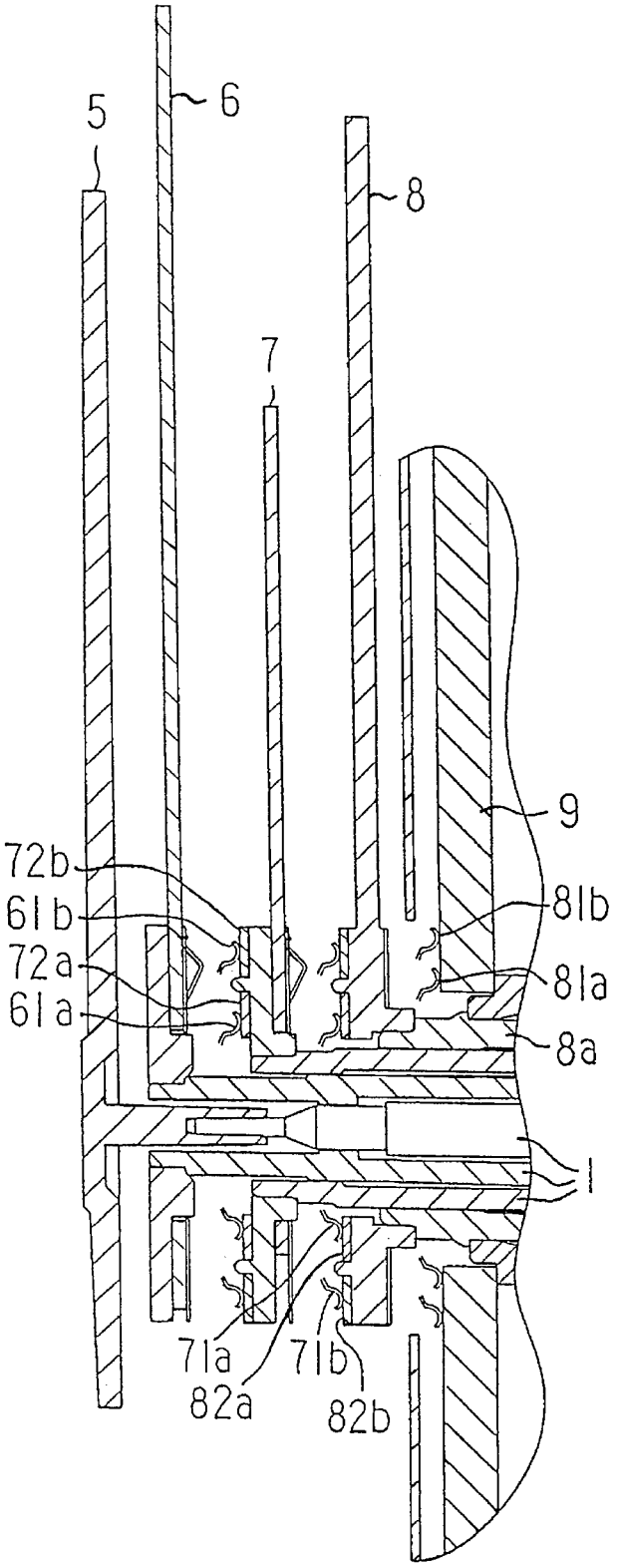
FIG. 3 is a partial sectional view of a timepiece incorporating an electroluminescent indicator hand in accordance with the present invention.
Figure 4A:
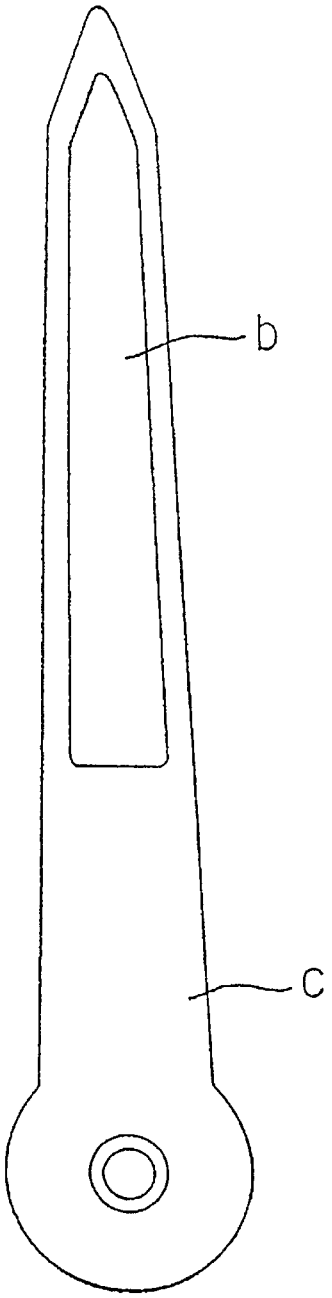
FIG. 4(a) (PRIOR ART)
FIG. 4(*a*) is a front view showing a conventional electroluminescent indicator hand.
Figure 4B:
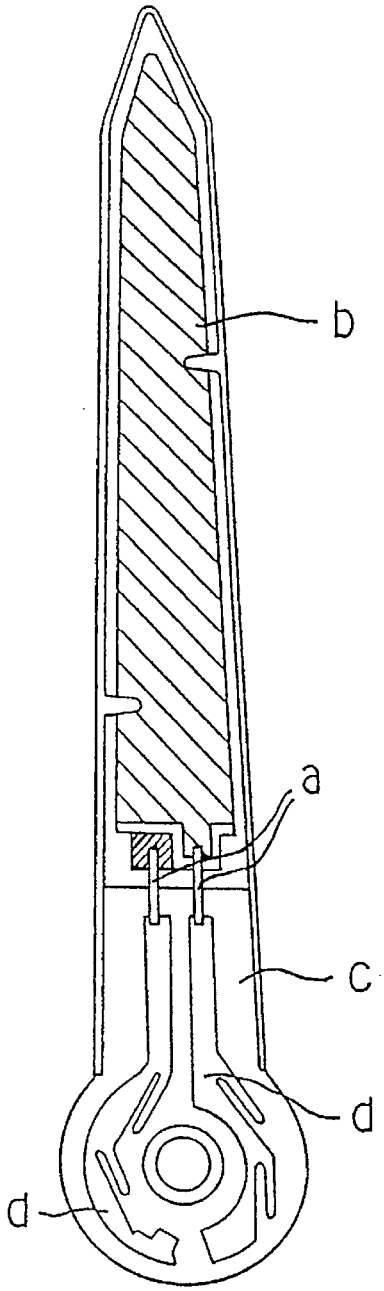
FIG. 4(b) (PRIOR ART)

The support member 2 has a ring shape and has a hole 21 formed at the center thereof which is fittingly coupled to a hand shaft 1 (shown in FIG. 3). Welding projections 22 are formed at six positions on the outer periphery of the rear surface of the support member 2 and are secured to the metal contacts 4*a*, 4*b*, as described later. A circular groove is formed in the inner periphery of the rear surface of the support member 2. An annular section 36 of the electroluminescent member 3 (shown by broken lines in FIG. 1(*b*) is fit in the circular groove 13 of the support member 2. In addition, a slot with a width substantially the same as that of the electroluminescent member 3 is formed in one end of the support member 2 (at the upper end thereof in FIG. 1(*a*). The base of the electroluminescent member 3 is frictionally engaged in the slot.

The electroluminescent member 3 is an elongated plate-like member with a sharp triangle at its tip, having the lower end thereof (at the lower end in FIG. 1) formed into the annular section 36. The diameter of the annular section 36 is smaller than that of the support member 2, and can fit in the groove formed in the inner periphery of the rear surface of the support member 2 as described earlier. The annular section 36 of the electroluminescent member 3 is welded to the support member 2 on its inner periphery of the rear surface, and the annular section 36 is held between the support member 2 and the metal contacts 4*a*, 4*b*, as described later.

Figure 2:
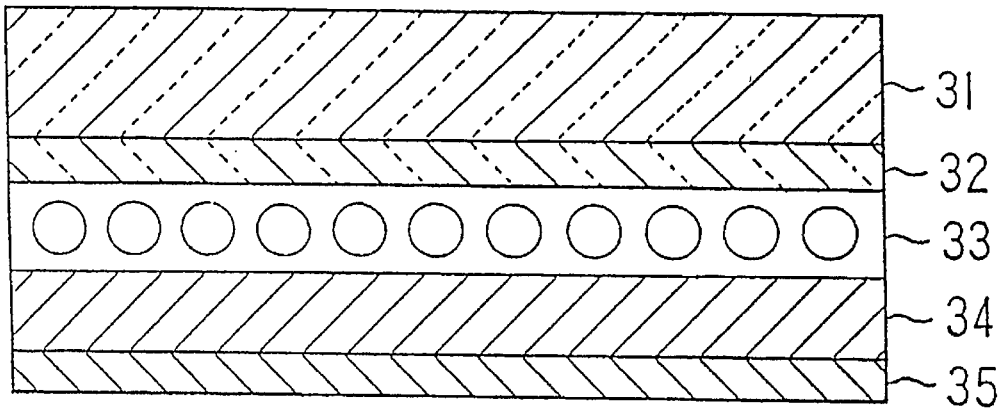
FIG. 2 is an enlarged cross-sectional view of the electroluminescent member of an electroluminescent indicator hand in accordance with the present invention.

As illustrated in FIG. 2, the electroluminescent member 3 is constructed by sequentially laminating a transparent electrode layer 32, a luminescent layer 33, an insulating layer 34, and a rear electrode layer 35 on the rear side of a light transmissive substrate 31. The specific arrangement of each layer is as follows.

The light transmissive substrate 31 is formed of a resin with sufficient rigidity, such as acryl resin. On the rear surface of the transmissive substrate 31 the transparent electrode layer 32 is deposited, for example, by vacuum evaporation or sputtering of a transmissive, conductive substance such as indium-tin-oxide (ITO).

The luminescent layer 33 is formed, for example, by the screen printing of a luminescent ink on the rear surface of the transparent electrode layer 32. A fluorescent material such as copper-doped zinc sulfide (ZnS) may be included in the composition of the luminescent ink. In view of its superior moisture resistant characteristics, a fluoride resin is preferably used as a binder. Such a resin may be produced by dissolving a copolymer of vinylidene fluoride and propylene hexafluoride in a methyl ethyl ketone solvent. The mixture of the fluorescent material and the fluoride resin binder may then be used as the luminescent ink. The luminescent ink is printed on the ITO vacuum-evaporated surface by a process such as screen printing, and is then heated and dried to form the luminescent layer 33.

The insulating layer 34 is formed of a highly dielectric material and a fluoride resin binder. Barium titanate ($BaTiO_3$) is preferably used as the highly dielectric material and is mixed and agitated with the fluoride resin binder to prepare an insulating ink. The insulating ink is printed on the luminescent layer 33 and is then heated and dried to form the insulating layer 34. The insulating layer 34 prevents moisture from penetrating into the luminescent layer 33. As will be appreciated by those of ordinary skill in the art, while the fluoride resin binder has a relatively low dielectric constant, the barium titanate has an extremely high dielectric constant and, as a result, the insulating layer will have a high overall dielectric constant so that the luminance of the electroluminescent member 3 is not in any way deteriorated by the low dielectric constant of the fluoride resin binder.

The rear electrode layer 35 is formed by mixing carbon powder, which is an electrically conductive material, with a polyester resin. More specifically, carbon powder and a resin binder formed of a polyester resin dissolved in a solvent, isohoron, are used. These materials are mixed and sufficiently agitated to prepare carbon ink. A reaction accelerator may be added to the carbon ink for accelerating the polymerization of the fluoride resin in the luminescent layer 33 and the insulating layer 34. Preferably, a reaction accelerator such as N-(amino ethyl) y-aminopropyl trimethoxysilane is used. This compound is an organic silicon monomer having two different reaction groups on its molecule. The carbon ink with the reaction accelerator additive is printed on the insulating layer 34 and then is heated and dried to form the rear electrode layer 35. The reaction accelerator penetrates into the insulating layer 34 and the luminescent layer 33 from the rear electrode layer 35 during heating and drying to accelerate the polymerization of fluoride resin in the insulating layer 34 and the luminescent layer 33, to increase the density of the fluoride resin, and to prevent the intrusion of moisture.

The arrangement and use of the metal contacts 4*a*, 4*b* will now be explained in greater detail. The metal contacts 4*a*, 4*b* are used for supplying a drive signal to the electroluminescent member 3, and, as shown in FIG. 1(*b*), the metal contacts 4*a*, 4*b* comprise a pair of identical contacts 4*a* (at the left in FIG. 1(*b*) and 4*b* (at the right in FIG. 1(*b*), which are disposed over the support member 2.

Formed at the tip of one of the metal contacts 4*a* (at the upper end thereof in FIG. 1(*b*) are short claw-shaped conductors 4*a*1, 4*a*1, the front ends of which resiliently contact the transparent electrode layer 32 of the electroluminescent member 3. Formed on the inner periphery of the metal contact 4*a* are long claw-shaped conductors 4*a*2, 4*a*2 which extend in the counterclockwise direction, and the ends of which are recessed to be in a different plane from that of the metal contact 4*a* (as shown in FIG. 1(*a*). The metal contact 4*a* has holes at three locations, one at each end and one in the center, through which the above-described welding projections 22 of the support member 2 pass and are welded.

Formed at the tip of one of the metal contacts 4*b* (at the upper end thereof in FIG. 1(*b*) are short claw-shaped conductors 4*b*1, 4*b*1 the front ends of which resiliently contact the rear electrode layer 35 of the electroluminescent member 3. Formed on the outer periphery of the metal contact 4*b* are long claw-shaped conductors 4*b*2, 4*b*2 which extend in the clockwise direction, and the ends of which are recessed to be in a different plane from that of the metal contact 4*b* (as shown in FIG. 1(*a*). The metal contact 4*b* has holes at three locations, one at each end and one in the center, into which the above-described welding projections 22 of the support member 2 extend and are welded.

Thus, the metal contacts 4*a* and 4*b* are welded, as shown in FIG. 1(*a*), on the metal contact welding projections 22 of the support member 2 around the annular section 36 of the electroluminescent member 3, and hold the electroluminescent member 3 in place between the contacts 4*a*, 4*b* and the support member 2.

FIG. 3 is an embodiment in which the electroluminescent indicator hand of the present invention is used as an indicator hand of a timepiece. A second hand 5, a minute hand 6, and an hour hand 7, shown from the left in the figure, are coupled to the end of the-hand shaft 1 which is rotationally driven by a timepiece movement (not shown). An alarm hand 8 is coupled to the shaft 8*a* of an alarm device. The electroluminescent indicator hands of the present invention are used in this embodiment as the minute hand 6 and the hour hand 7.

A description will now be provided of a means for supplying a drive signal to the electroluminescent members of the respective electroluminescent minute hand 6 and hour hand 7.

As shown in FIG. 3, metal leads 61*a*, 61*b*, and 71*a*, 71*b* which are similar to the above-described metal leads 4*a*2, 4*b*2 are provided on the rear surface of the minute hand 6 and the hour hand 7, respectively. Concentric conductor rings 72*a* and 72*b* are provided on the front surface of the hour hand 7 for supplying the drive signal to the metal leads 61*a* and 61*b*. In addition, concentric conductor rings 82*a* and 82*b* are provided on the front surface of the alarm hand 8 for supplying the drive signal to the metal leads 71*a* and 71*b*. Metal leads 81*a* and 81*b* are provided on the rear surface of the alarm hand 8 to be conductive with two leads of a printed circuit board 9 mounted on the front of the timepiece movement.

Accordingly, a drive signal supplied by the printed circuit board 9 is fed to the conductor rings 82*a*, 82*b* through the metal leads 81*a*, 81*b* of the alarm hand 8. The signal is then supplied to the transparent electrode layer and the rear electrode layer of the electroluminescent member of the hour hand 7 through the metal leads 71*a*, 71*b* of the hour hand, and to the conductor rings 72*a*, 72*b* of the hour hand 7. The signal is also supplied to the transparent layer and the rear electrode layer of the minute hand 6 through the metal leads 61*a*, 61*b* of the minute hand 6. The electroluminescent members of the minute hand 6 and the hour hand 7 therefore emit light in response to an applied signal.

When a capacitive transmissive substrate is used in place of the light transmissive substrate 31 integrally formed on the electroluminescent member, an edge light effect will be further promoted so that the three-dimensional visual effect of the inventive electroluminescent indicator hand is further enhanced.

In addition, the electroluminescent indicator hand may become illuminated in any desired color by tinting the light transmissive substrate 31 in the desired color.

Furthermore, protection from the entry of moisture into the electroluminescent member may be enhanced by use of a moisture resistant coating layer on the rear surface of the rear electrode layer 35.

In accordance with the present invention, since the respective successively laminated layers forming the electroluminescent member are formed on the rear surface of a light transmissive substrate, the electroluminescent member can itself be used as the hand. Thus, the hand frame of the conventional electroluminescent indicator hand becomes unnecessary so that the structure of hand can be simplified to reduce the cost of the components and the assembly thereof. In addition, by using the structure disclosed by the present invention, the electroluminescent indicator hand may be formed thinner that the conventional indicator hand. Moreover, because the entire hand, including the sides thereof, become luminous in response to an input signal and exhibit an edge light effect, it is possible to attain a three-dimensional and visually pleasing effect which cannot be achieved in the conventional luminous hand.

We claim:

1. An electroluminescent indicator hand comprising: an annular support member; an electroluminescent member secured on the support member; and a metal contact for supplying a drive signal to the electroluminescent member; wherein the electroluminescent member comprises a laminated structure having a transparent electrode layer, a luminescent layer, an insulating layer and a rear electrode layer disposed on a light transmissive substrate having an annular section overlapping the support member, and wherein the metal contact has conductors resiliently contacting the transparent electrode layer and the rear electrode layer of the electroluminescent member.

2. An electroluminescent indicator hand according to claim 1; wherein the metal contact is welded to the support member with the annular section of the electroluminescent member disposed therebetween.

3. An electroluminescent indicator hand according to claim 1; wherein the transparent electrode layer comprises indium-tin-oxide.

4. An electroluminescent indicator hand according to claim 1; wherein the transmissive substrate is formed of acryl resin.

5. An electroluminescent indicator hand according to claim 1; wherein the luminescent layer is formed of a luminescent material and copper-doped zinc sulfide.

6. An electroluminescent indicator hand according to claim 1; wherein the luminescent layer includes a fluoride resin.

7. An electroluminescent indicator hand according to claim 1; wherein the insulating layer is formed of a highly dielectric material and a fluoride resin binder.

8. An electroluminescent indicator hand according to claim 1; wherein the insulating layer and the luminescent layer contain a fluoride resin and a reaction accelerator is included in the rear electrode layer to promote polymerization of the fluoride resin to enhance the moisture resistance of the electroluminescent member.

* * * * *